United States Patent [19]

Huszczo

[11] Patent Number: 4,466,450

[45] Date of Patent: Aug. 21, 1984

[54] TOBACCO CURING BARN

[76] Inventor: Walter Huszczo, R.R. 2, Burford, Ontario, Canada, N0E 1A0

[21] Appl. No.: 382,646

[22] Filed: May 27, 1982

[30] Foreign Application Priority Data

Jul. 16, 1981 [CA] Canada ..... 381849

[51] Int. Cl.[3] ..... A24B 3/10

[52] U.S. Cl. ..... 131/300; 131/302; 131/303; 131/304; 131/306

[58] Field of Search ..... 131/290, 300, 301, 302, 131/303, 304, 306; 432/500

[56] References Cited

U.S. PATENT DOCUMENTS

| | | | |
|---|---|---|---|
| 3,834,137 | 9/1974 | Long | 131/300 |
| 3,888,533 | 6/1975 | Long | 131/300 |
| 3,932,946 | 1/1976 | Johnson | 131/300 |
| 3,935,648 | 2/1976 | Cox | 131/300 |
| 3,935,959 | 2/1976 | Long | 131/300 |
| 3,946,542 | 3/1976 | Long | 131/300 |
| 4,021,928 | 5/1977 | Johnson | 131/300 |
| 4,259,787 | 4/1981 | Minshall et al. | 131/300 |

*Primary Examiner*—V. Millin

*Attorney, Agent, or Firm*—Banner, Birch, McKie & Beckett

[57] ABSTRACT

This invention relates to a forced air recirculation tobacco curing apparatus which provides support for tobacco bins within the apparatus and is adapted to permit a loading vehicle to drive in and out of the apparatus to load or unload the bins.

5 Claims, 6 Drawing Figures

TOBACCO CURING BARN

This invention relates to apparatus for curing tobacco, more particularly it relates to forced air bulk curing apparatus.

In the prior art many methods of curing tobacco have been disclosed. The historical method essentially comprised hanging bunches of leaves in a heated barn under roughly controlled conditions of temperature and humidity. In more recent developments it was found that tobacco could be packed in bulk and cured in forced air recirculation kilns. For example, in U.S. Pat. No. 3,110,326 issued to Hassler on Nov. 2, 1963, apparatus and methods were disclosed for forced air bulk curing of tobacco. Since that date various embodiments of forced air tobacco curing kilns have been disclosed by a number of manufacturers.

A forced air bulk curing kiln for tobacco is often about the size and shape of a trailer portion of a tractor-trailer trucking rig. Usually a forced air furnace is located at one end of the kiln. The furnace is separated by a partition wall from the remainder of the interior of the kiln where the tobacco is cured. A door is usually located at the end of the kiln opposite the furnace to permit tobacco to be loaded and unloaded therefrom. It is known to cure tobacco with either indirectly or directly heated air. In the latter case the fuel should burn cleanly so that the products of combustion in the heated air do not contaminate the tobacco.

During the curing operation heated air from the furnace is recirculated through the kiln upwards from floor to ceiling. Usually, there is a double floor, that is an upper and lower floor, between which is a lower plenum chamber in communication with ducts supplying heated air from the furnace. The upper floor is perforated to permit the air to pass from the plenum chamber into the portion of the kiln where the tobacco is placed (the curing chamber). Above the tobacco may be a double ceiling (the lower ceiling being perforated to admit air) forming an upper plenum chamber in communication with the intake of the furnace through appropriate ducts in the partition wall. Thus, air may be circulated from the furnace to the lower plenum chamber, through the upper floor into the curing chamber, through the lower ceiling to the upper plenum chamber and back to the furnace. It is also known to have controllable intake openings to admit fresh air to the furnace and to have controllable exhaust vents to exhaust air from the upper plenum chamber. Usually such exhaust vents are placed at the end of the upper plenum chamber over the door.

Tobacco may be bulk packed in a kiln of this type by horizontally suspending one or two tiers of racks having tynes with tobacco leaves bulk packed thereon with their leaf surfaces in a vertical plane. In other words, the tobacco leaves are pierced through by one or more tynes on a rack and packed together in bulk. The racks are then hung in the curing chamber adjacent one another so as to substantially occupy all of the horizontal area of the curing chamber at usually two levels of the curing chamber. Curing air is then blown up through the perforated floor throughout the area of the curing chamber in and amongst the tobacco leaves to the ceiling.

Another method of bulk packing tobacco for curing involves the use of bins which may be loaded or unloaded from the curing chamber. Essentially, the bins have perforated tops and bottoms to permit air to pass through them when they are in the curing chamber. Each bin also has a door in its side to permit tobacco leaves to be placed in it or removed therefrom. To place tobacco in the bin, it is laid over on its side and the door is opened. Then tobacco leaves are randomly placed into the bin but oriented to lie face to face in planes perpendicularly intersecting the perforated top and bottom of the bin. The door is then shut and tynes are inserted through a plurality of holes in the doors to pierce the tobacco leaves to fix the position of the bulk pack in the bin. The bin is righted to stand on its bottom so that the leaves hang vertically. Then the bin and other similar bins are loaded into the curing chamber adjacent one another to fill the horizontal area of the curing chamber and the curing process is begun.

It is, of course, important in both types of bulk packing tobacco to fill the horizontal area of the curing chamber so that the curing air will circulate through the tobacco rather than take a path of less resistance.

The use of tobacco curing bins provides a convenient means of getting tobacco bulk packed for curing, however, it has some disadvantages. Unlike racks of tobacco, it is not feasible for the bins to be hand carried into the curing chamber and suspended in place. Accordingly, various methods and means have been devised for loading. For example, cranes have been used to lift the bins onto carriages that ride on rails extending into the curing chamber over the upper floor. Usually, there is some kind of elevated loading dock that connects with the rails in the curing chamber. Often the loading dock is moveable from kiln to kiln carrying the crane upon it. This method and others like it which have been tried by persons skilled in the art have associated problems of cost, complexity and ultimate utility.

It is an object of this invention to provide an improved forced air curing kiln and bin combination for bulk curing of tobacco.

It is an object of this invention to provide an improved forced air curing kiln and bin combination for bulk curing of tobacco.

It is an object of this invention to provide a kiln and bin combination that permits bins to be simply and effeciently loaded into a kiln.

Further to these and other objects which will become apparent from the specification, this invention discloses apparatus for bulk curing tobacco comprising in combination a plurality of tobacco curing bins and a forced air recirculation kiln with a curing chamber having a ground level floor and being accessible by a door at one end of the kiln so as to permit a bin loading vehicle to drive into the curing chamber on the ground level floor to bring bins into or to remove bins from the curing chamber. The curing chamber is being adapted with support means to suspend the plurality of bins within said curing chamber in a row fillinga the horizontal area of the curing chamber and vertically positioned between means to supply and means to exhaust recirculating curing air.

The tobacco curing kiln of this invention is designed to permit a loading vehicle to drive directly into the curing chamber to load or unload bins. More particularly, the tobacco curing apparatus of this invention comprises in combination, a plurality of removeable tobacco curing bins and a kiln including a forced air furnace means, a curing chamber having a ground floor accessible to a loading vehicle by a door at one end thereof. The curing chamber and the forced air furnace means are in communication for recirculation of curing air by means of at least one curing air supply duct and at least one curing air return duct located at lower and upper positions of the curing chamber respectively. The curing chamber is further adapted to support within a horizontal abutting row of removeable tobacco bins having substantially air tight seals between the bins themselves and between the bins and all sides of the curing chamber but positioned vertically between the supply and return air ducts so as to form a first plenum below and a second plenum above the bins within the curing chamber in communication with the supply and return ducts respectively. Each bin is adapted to contain bulk packed tobacco leaves having leaf faces aligned vertically when the bin is positioned in the curing chamber and has bottom and top openings in communication with the first and second plenums respectively. Accordingly there is established a forced curing air recirculation system whereby heated air may be blown at predetermined pressure and temperature from the furnace means to the supply duct(s) and the first plenum through each of the bottom openings of the bins, about the tobacco leaves therein, out of the top openings of the bins into the second plenum to the return duct(s) and back to the furnace means for recirculation, said recirculation system having inlet means and exhaust means to controllably intake or discharge predetermined amounts of air to or from the recirculated system.

It will be appreciated that a number of means might be used to support the bins in position in the curing chamber. For example, the bins might be hung from the ceiling, suspended on hooks or the like from the sides of the chamber or supported below by structures adapted to allow the loading vehicle to drive between them. However, it is preferred that the support means in the curing chamber comprise shelf means extending horizontally along each side wall of the curing chamber at a vertical position above the supply duct(s), said shelf means being adapted to support the opposite ends of tobacco curing bins resting transversely over and between them. In a preferred embodiment of this invention the shelf means also forms a part of the structure of the kiln itself. In this embodiment the shelf means comprises a box beam lying longitudinally along the lower portion of each side wall of the curing chamber extending vertically from the floor to a position above the supply duct(s).

The floor of the curing kiln preferably comprises a concrete pad at ground level. The concrete pad is adapted to support the loading vehicle and to facilitate the entry of the vehicle into the curing chamber. The remainder of the kiln structure may then be located over the concrete pad and sealed airtight about the edges with suitable caulking.

Figure 1:
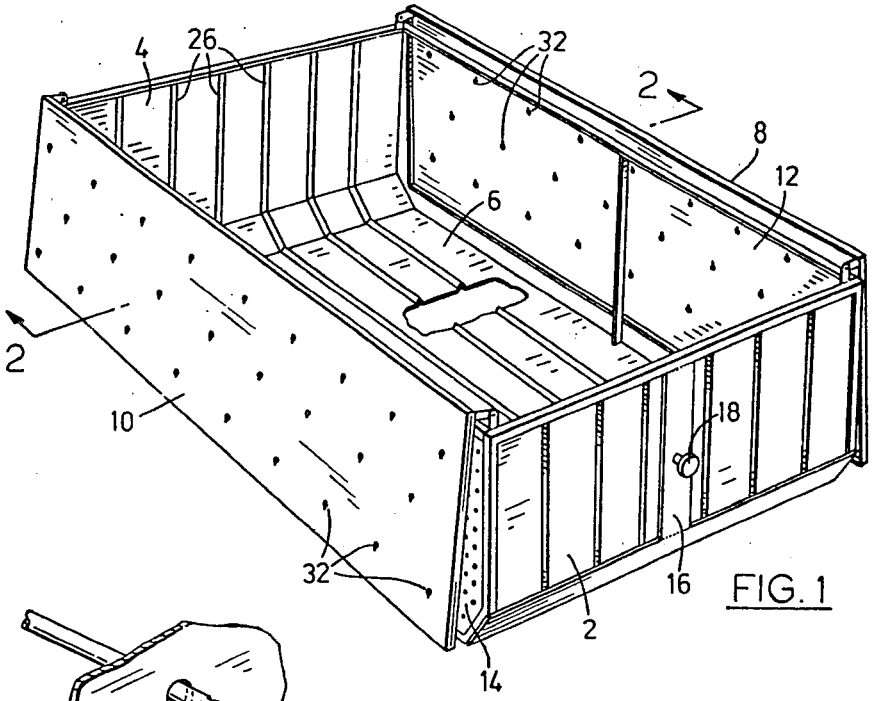
FIG. 1 is an illustration of a tobacco curing bin of the preferred embodiment of this invention.
Figure 3:
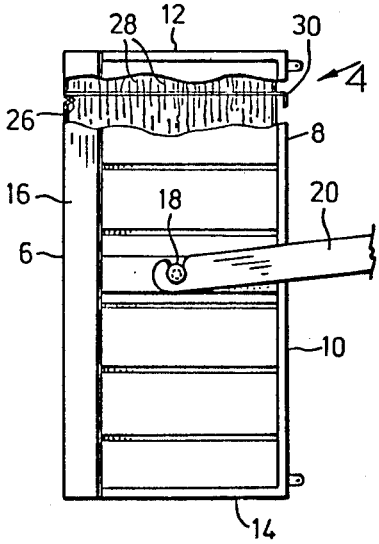
FIG. 3 is an illustration of the tobacco curing bin righted for placement in the curing chamber.
Figure 5:
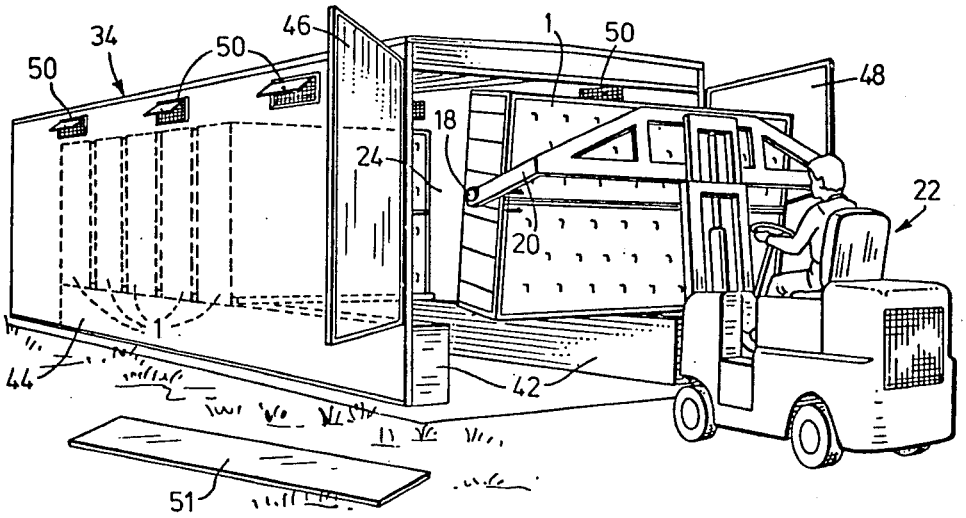
FIG. 5 is an illustration of tobacco bins being loaded into the curing chamber of a kiln.

The tobacco curing bin of this invention, shown in FIG. 1, lying on its side, essentially comprises a box having ends (2) and (4), a side (6) and hinged doors (8) and (10). The top (12) is open and the bottom (14) is perforated to permit circulation of air through the bin during curing. At each of the ends (2) and (4) there is a steel frame (16) having a pin (18) extending laterally therefrom. As shown in FIGS. 3 and 5 the pins (18) are adapted to link with lifting arms (20) of a loading vehicle (22) to permit the bins to be carried to and from the curing chamber (24). The pins (18) are located slightly off centre towards the top (12) of the bin. Therefore, when the loading vehicle (22) lifts the bin from the position shown in FIG. 1, the bin will, under force of gravity rotate and right itself to the position shown in FIG. 3 ready for insertion into the curing chamber (24).

The side (6) and ends (2) and (4) of the bin have corrugations (26) which strengthen the bin and act as baffles to prevent air from passing along the interior surfaces of the bin without going through the tobacco.

Figure 2:
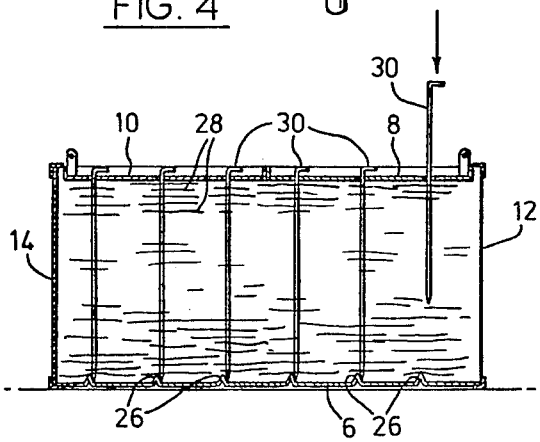
FIG. 2 is a sectional end view of a tobacco curing bin loaded with tobacco.

As shown in FIGS. 1 and 2, initially the bin is placed on its side (6) and the doors (8) and (10) are opened. Tobacco leaves (28) are then laid into the bin in the bulk pack filling the bin with the leaf faces in planes parallel to side (6). Doors (8) and (10) are then closed and tynes (30) are inserted through keyholes (32) in the doors (8) and (10), punched through the tobacco leaves (28) to rest against the top side of corrugations (26). Thus, when the bin is righted, as shown in FIG. 3, the tynes (30), supported in the keyholes (32) and on corrugations (26), are able to prevent the tobacco leaves (28) from slipping within the bin thereby maintaining the uniformity of the bulk pack of tobacco.

Figure 4:
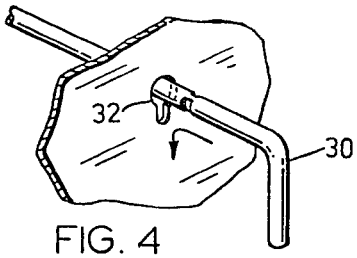
FIG. 4 is an illustration of the tynes used to hold the tobacco leaves in position in the bin.
Figure 6:
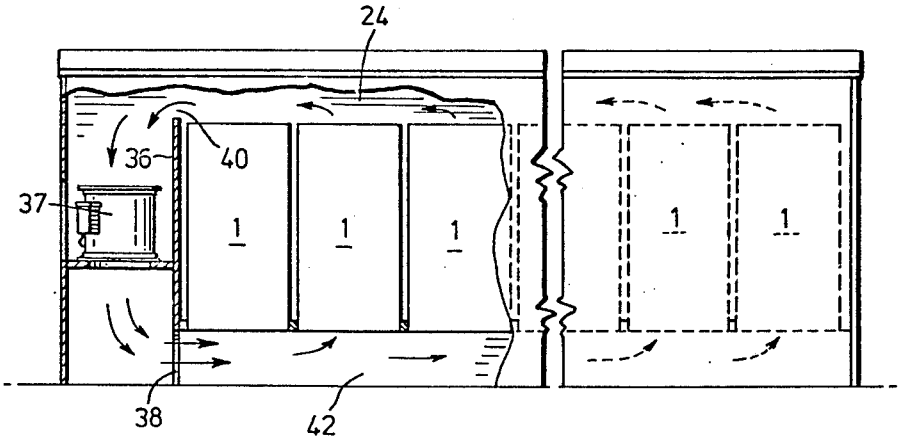
FIG. 6 is an illustration of the tobacco curing kiln during the curing cycle.

As shown in FIG. 4 the tynes may be notched for securement in the lower part of the keyhole (32). The tobacco curing kiln (34) is shown in FIGS. 5 and 6. As shown in the schematic diagram in FIG. 6, there is a forced air furnace (36) at one end of the kiln (34) separated from the curing chamber (24) by a partition wall (36). Below the partition (36) is a curing air supply duct (38) while above the partition (36) is the curing air return duct (40). The furnace (37) illustrated is a direct heating furnace which permits the products of combustion to mix with the curing air. The construction of the furnace is well known to those skilled in the art and need not be described here.

As shown in FIGS. 5 and 6, the bins are placed by the loading vehicle (22) on box beams (42) which run longitudinally along the sides (44) of the kiln (34) within the curing chamber (24) and from a part of the kiln framework. The loading vehicle simply picks up a bin (1) by means of arms (20), allows the bin (1) to rotate to right itself so that the open top is up and the perforated bottom is down, then the vehicle drives into the curing chamber (24) and deposits the bin (1) on the box beams (42). As shown in FIG. 6, it is preferred that a small (about 2"×2") piece of wood (44) be placed across the box beams (42) between the bins (1) and between the bins (1) and the partition wall (40) to seal off air that might otherwise pass in between. It will be appreciated that there are a variety of ways that the bins might be sealed. For example, a small protrusion at the bottom of each bin might be used to overlay any gap between the bins. The small piece of wood (44) is preferred however because it is cheap, easy to install and not as subject to damages during handling of the bins.

During the loading of the bins (1) the kiln doors (46) and (48) are swung open and a bottom panel (50) is removed to permit loading vehicle (22) to go in and out of the curing chamber (24). After the curing chamber (24) is fully loaded, bottom panel (50) is attached to cover the bottom part of the curing chamber (24) below the top of the box beams (42). Then the doors (46) and (48) are closed and the curing cycle may be started. The bottom panel (50) permits the doors (46) and (48) to be opened during the curing cycle for inspection without permitting the curing air to blow directly out of the curing chamber (24) below the bins (1).

It will be appreciated that if there is a partial load of bins (1) the curing air may be cut off at the last bin by inserting a sheet of plywood or the like between the box beams (42) extending from the floor to the bottom part of the last bin closest to the door. Thus the flow of air is directed into the bins and does not escape into the unfilled portion of the curing chamber.

The curing sequence is conventional and known to those skilled in the art and need not be described here. However, the kiln of this invention has the additional improvement that the vents (51) are spaced along the sides of the curing chamber rather than at one end. This permits greater control over the humidity at various positions along the length of the curing chamber.

The operation of unloading the tobacco from the kiln is essentially the reverse of the loading procedure.

It will be appreciated by those skilled in the art that the construction of the preferred embodiment described above may be modified without departing from the invention disclosed herein.

The embodiments of the invention in which an exclusive property or privilege is claimed are defined as follows:

1. Tobacco curing apparatus comprising in combination a plurality of removeable tobacco curing bins and a kiln including a forced air furnace means, a curing chamber having a ground floor accessible to a loading vehicle by a door at one end thereof, said curing chamber and such forced air furnace means being in communication for recirculation of curing air by means of at least one curing air supply duct and at least one curing air return duct located at lower and upper positions of the curing chamber respectively, said curing chamber having support means adapted to support within the curing chamber a horizontal abutting row of removeable tobacco curing bins having substantially air tight seals between the bins themselves and between the bins and all sides of the curing chamber but positioned vertically between the supply and return air ducts so as to form a first plenum below and second plenum above the bins within the curing chamber in communication with supply and return ducts respectively, each said bin being adapted to contain bulk packed tobacco leaves having leaf faces aligned vertically when the bin is positioned in the curing chamber and being further adapted with bottom and top openings in communication with the first and second plenums respectively, all of which is adapted to establish the forced curing air recirculation system whereby heated air may be blown at predetermined pressure and temperature from the furnace means to the supply duct(s) to the first plenum, through each of the bottom openings of the bins, about the tobacco leaves therein, out the top openings of the bins into the second plenum through the return air duct(s) and back to the furnace means for recirculation, said recirculation system having inlet means and exhaust means to controllably intake or discharge predetermined amounts of air to or from the recirculation system.

2. The apparatus of claim 1 in which the support means in the curing chamber comprises shelf means extending horizontally along each side wall of the curing chamber at a vertical position above the supply duct(s), said shelf means being adapted to support the opposite ends of tobacco curing bins resting transversely over and between them.

3. The apparatus of claim 2 in which the shelf means also forms part of the supporting structure of the kiln itself and comprises a box beam lying longitudinally along the lower portion of each side wall of the curing chamber extending vertically from the floor to the ceiling above the supply duct(s).

4. The apparatus of claims 1 or 2 in which the ground level floor of the curing chamber comprises a concrete pad at ground level adapted to support a loading vehicle and to facilitate the entry of the vehicle into the curing chamber.

5. An apparatus for bulk curing tobacco comprising a combination of forced air furnace means, a curing chamber and removeable tobacco means, said forced air furnace and curing chamber being in a kiln structure but separated by a partition wall having a supply duct and a return duct in communication with said furnace and said curing chamber, said supply and return ducts being located at lower and upper positions of the partition wall respectively, said curing chamber being formed by a roof, the partition wall, longitudinal side walls extending therefrom to a door means all of which is located with a substantially air tight seal on a concrete floor pad on the ground underlying and supporting the kiln structure, said longitudinal side walls having box beams extending horizontally along their length from the partition wall to the door means within the curing chamber and extending vertically from the concrete floor pads to a position above the supply ducts, said box beams being adapted to structurally support the kiln while providing two shelves upon which bins of tobacco leaves may be placed so as to extend across the curing chamber between the longitudinal side walls in a row from the partition wall to the door means having substantially air tight seals between the bins and between the bins and the partition wall, the box beams and the door means, said bins being of a size to allow a first plenum and a second plenum below and above the bins in communication with the supply and return ducts respectively, each said bin being adapted to contain bulk packed tobacco leaves having leaf faces aligned vertically when the bin is positioned in the curing chamber and being further adapted with top and bottom openings in communication with the first and second plenums respectively, all of which establishes a forced air recirculation system whereby heated air may be blown at predetermined pressure and temperature from the furnace means to the supply ducts and the first plenum through the bins and about the tobacco therein to a second plenum and the return ducts back to the furnace for recirculation, such second plenum having controllable exhaust louvres equidistantly spaced along at least one longitudinal side wall, such furnace means having a controllable intake vent to allow the admission of fresh air to the recirculation system.

* * * * *